US012071281B2

(12) United States Patent
Valencia

(10) Patent No.: US 12,071,281 B2
(45) Date of Patent: Aug. 27, 2024

(54) NESTED PAPER TRAY HAVING DIVIDED COMPARTMENTS

(71) Applicant: WESTROCK SHARED SERVICES, LLC, Atlanta, GA (US)

(72) Inventor: John Valencia, Johns Creek, GA (US)

(73) Assignee: WestRock Shared Services, LLC, Atlanta, GA (US)

( * ) Notice: Subject to any disclaimer, the term of this patent is extended or adjusted under 35 U.S.C. 154(b) by 54 days.

(21) Appl. No.: 17/599,990

(22) PCT Filed: Mar. 27, 2020

(86) PCT No.: PCT/US2020/025313
§ 371 (c)(1),
(2) Date: Sep. 29, 2021

(87) PCT Pub. No.: WO2020/205550
PCT Pub. Date: Oct. 8, 2020

(65) Prior Publication Data

US 2022/0144478 A1 May 12, 2022

Related U.S. Application Data

(60) Provisional application No. 62/826,514, filed on Mar. 29, 2019.

(51) Int. Cl.
*B65D 5/28* (2006.01)
*B65D 5/4805* (2006.01)

(52) U.S. Cl.
CPC ..... *B65D 5/28* (2013.01); *B65D 5/48022* (2013.01)

(58) Field of Classification Search
CPC .... B65D 5/28; B65D 5/48022; B65D 5/5495; B65D 5/5445; B65D 5/2047; B65D 5/244; B65D 5/48
USPC ..... 229/117.01, 114, 120.03, 120.17, 229/120.011, 120.08, 120.09, 120.11, 229/120.13, 120.16, 906, 172; 206/750, 206/526, 561, 747; 493/128, 90, 912; 220/557
See application file for complete search history.

(56) References Cited

U.S. PATENT DOCUMENTS 4,848,648 A 7/1989 Eisman
5,009,363 A 4/1991 Zavatone
5,855,315 A * 1/1999 Roseth ..... B65D 5/5495 229/120.04

(Continued)

*Primary Examiner* — Christopher R Demeree
(74) *Attorney, Agent, or Firm* — Brian J. Goldberg; Rohini K. Garg

(57) ABSTRACT

A tray (100) including a first compartment portion (20) having a bottom panel (22), a first side panel (24) connected to the bottom panel, a second side panel (26) connected to the bottom panel, a front panel (28) connected to the bottom panel and a rear panel (30) connected to the bottom panel, and a second compartment portion (40) having a bottom panel (42), a first side panel (44) connected to the bottom panel and connected to the second side panel of the first compartment portion along an adjoining fold line (35), a second side panel (46) connected to the bottom panel, a front panel (48) connected to the bottom panel and a rear panel (50) connected to the bottom panel, wherein the front and rear panels of the second compartment portion each have a tab (48*a*, 50*a*) for securement to the front and rear panels of the first compartment portion.

19 Claims, 8 Drawing Sheets

(56) References Cited

U.S. PATENT DOCUMENTS

| | | | | |
|---|---|---|---|---|
| 5,909,840 | A * | 6/1999 | Schultheiss | B65D 5/48018 229/172 |
| 6,129,211 | A * | 10/2000 | Prakken | B65D 5/5405 229/120.09 |
| 6,729,475 | B2 * | 5/2004 | Yuhas | B65D 5/5495 229/120.08 |
| 6,913,189 | B2 * | 7/2005 | Oliff | B65D 5/5495 229/120.011 |
| 2011/0253587 | A1 | 10/2011 | Pinkstone | |

* cited by examiner

NESTED PAPER TRAY HAVING DIVIDED COMPARTMENTS

BACKGROUND OF THE INVENTION

1. Field of the Invention

The subject invention is directed to product packaging, and more particularly, to a paper tray having divided compartments for packaging products, which is adapted and configured to be nested together with other like trays.

2. Description of Related Art

Currently, trays having divided compartments for packaging products such as cookies and the like, are made from plastic materials. This presents an environmental issue, since plastic products are not fully recyclable.

It would be beneficial therefore, to provide compartmented trays that are made from paper board materials, which are fully recyclable and safe for the environment. It would also be beneficial to provide compartmented trays in a configuration that promotes nesting, so that multiple compartmented trays can be packaged together for shipment and use in an efficient manner.

The subject invention provides such a solution by providing a die cut paper board blank that can be formed into a tray having two or more divided compartments, which is adapted and configured to be nested with other trays so they can be packaged together for shipment and use.

SUMMARY OF THE DISCLOSURE

The subject invention is directed to a die cut paper or paperboard blank for constructing a tray having divided compartments. The blank includes a first compartment portion having a bottom panel, a first side panel foldably connected to a first side edge of the bottom panel, a second side panel foldably connected to a second side edge of the bottom panel, a front panel foldably connected to a front edge of the bottom panel and a rear panel foldably connected to a rear edge of the bottom panel.

The blank further includes a second compartment portion having a bottom panel, a first side panel foldably connected to a first side edge of the bottom panel and foldably connected to the second side panel of the first compartment portion along an adjoining fold line, a second side panel foldably connected to a second side edge of the bottom panel, a front panel foldably connected to a front edge of the bottom panel and a rear panel foldably connected to a rear edge of the bottom panel, wherein the front and rear panels of the second compartment portion each have an integral glue tab for securement to exterior surfaces of the front and rear panels of the first compartment portion.

The first side panel of the first compartment portion has front and rear glue tabs foldably connected to respective front and rear edges thereof for securement to interior surfaces of the front and rear panels of the first compartment portion. The second side panel of the second compartment portion has front and rear glue tabs foldably connected to respective front and rear edges thereof for securement to interior surfaces of the front and rear panels of the second compartment portion.

The blank further includes a third compartment portion having a bottom panel, a first side panel foldably connected to a first side edge of the bottom panel and a second side panel foldably connected to a second side edge of the bottom panel and foldably connected to the first side panel of the first compartment portion along an adjoining fold line, a front panel foldably connected to a front edge of the bottom panel and a rear panel foldably connected to a rear edge of the bottom panel, wherein the front and rear panels of the third compartment portion each have an integral glue tab for securement to exterior surfaces of the front and rear panels of the first compartment portion. The first side panel of the third compartment portion has front and rear glue tabs that are foldably connected to respective front and rear edges thereof for securement to interior surfaces of the front and rear panels of the third compartment portion.

The front and rear edges of each side panel of each compartment portion are angled with respect to the side edges of the side panels, and the front and rear panels of each compartment portion have oppositely angled side edges. In addition, the front edges of adjoining side panels are oppositely angled, and the rear edges of adjoining side panels are also oppositely angled. The first and second side edges of the bottom panel of each compartment portion are parallel to one another, and the adjoining fold line is parallel to the first and second side edges of the bottom panel of each compartment portion.

The second side panel of the first compartment portion and the adjoining first side panel of the second compartment portion have an equal width, which is less than a width of the first side panel of the first compartment portion and a width of the second side panel of the second compartment portion. The width of the first side panel of the first compartment portion and the width of the second side panel of the second compartment portion are equal to one another. The bottom panels of each compartment portion have an equal width.

The subject invention is also directed to a tray formed from a blank of paper or paperboard material that has divided compartments. The tray includes a first compartment portion having a bottom panel, a first side panel foldably connected to a first side edge of the bottom panel, a second side panel foldably connected to a second side edge of the bottom panel, a front panel foldably connected to a front edge of the bottom panel and a rear panel foldably connected to a rear edge of the bottom panel.

The tray further includes a second compartment portion having a bottom panel, a first side panel foldably connected to a first side edge of the bottom panel and foldably connected to the second side panel of the first compartment portion along an adjoining fold line, a second side panel foldably connected to a second side edge of the bottom panel, a front panel foldably connected to a front edge of the bottom panel and a rear panel foldably connected to a rear edge of the bottom panel, wherein the front and rear panels of the second compartment portion each have a glue tab secured to exterior surfaces of the front and rear panels of the first compartment portion.

The first side panel of the first compartment portion has front and rear glue tabs foldably connected to respective front and rear edges thereof and secured to interior surfaces of the front and rear panels of the first compartment portion. The second side panel of the second compartment portion has front and rear glue tabs foldably connected to respective front and rear edges thereof and secured to interior surfaces of the front and rear panels of the second compartment portion.

The tray further includes a third compartment portion having a bottom panel, a first side panel foldably connected to a first side edge of the bottom panel and a second side panel foldably connected to a second side edge of the bottom panel and foldably connected to the first side panel of the first compartment portion along an adjoining fold line, a front panel foldably connected to a front edge of the bottom panel and a rear panel foldably connected to a rear edge of the bottom panel, wherein the front and rear panels of the third compartment portion each have a glue tab secured to exterior surfaces of the front and rear panels of the first compartment portion. The first side panel of the third compartment portion has front and rear glue tabs foldably connected to respective front and rear edges thereof secured to interior surfaces of the front and rear panels of the third compartment portion.

These and other features of the compartmented trays of the subject invention will become more readily apparent to those having ordinary skill in the art to which the subject invention appertains from the detailed description of the preferred embodiments taken in conjunction with the following brief description of the drawings.

BRIEF DESCRIPTION OF THE DRAWINGS

So that those skilled in the art will readily understand how to make and use the compartmented trays of the subject invention without undue experimentation, preferred embodiments thereof will be described in detail herein below with reference to the figures wherein.

DETAILED DESCRIPTION OF THE PREFERRED EMBODIMENTS

Figure 1:
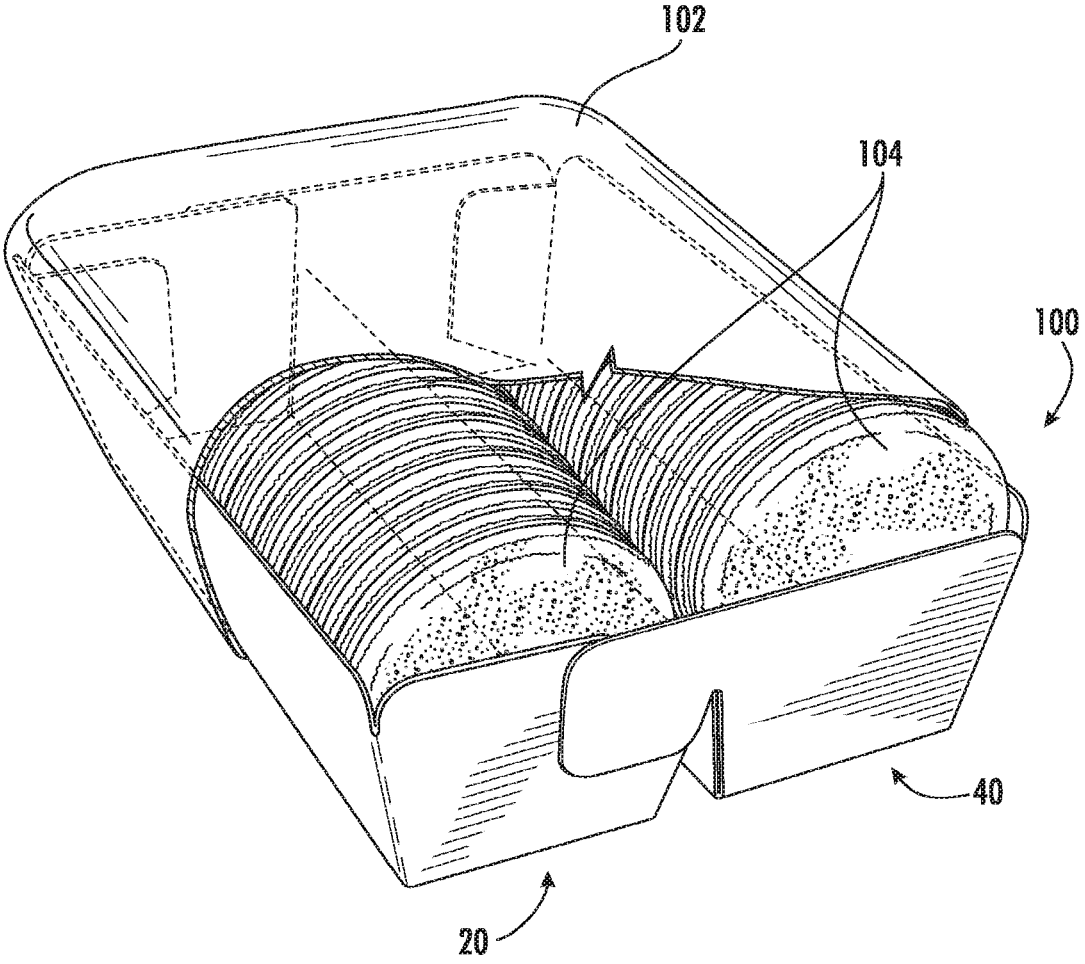
FIG. 1 is a perspective view of an embodiment of the tray of the subject invention, which has two divided compartments, and which is shown containing products and enclosed within a package.

Referring now to the drawings wherein like reference numerals identify similar structural features or elements of the subject invention, there is illustrated in FIG. 1 a compartmented tray 100 contained within a packaging enclosure 102 and having two compartment portions 20, 40 for packaging food products such as cookies 104 or the like, and which is adapted and configured to be nested with other compartmented trays 100 so they can be packaged together for shipment and use, as explained in more detail below. The compartmented tray 100 is erected from a die cut paper or paperboard blank 10, which is illustrated in FIG. 2.

Figure 2:
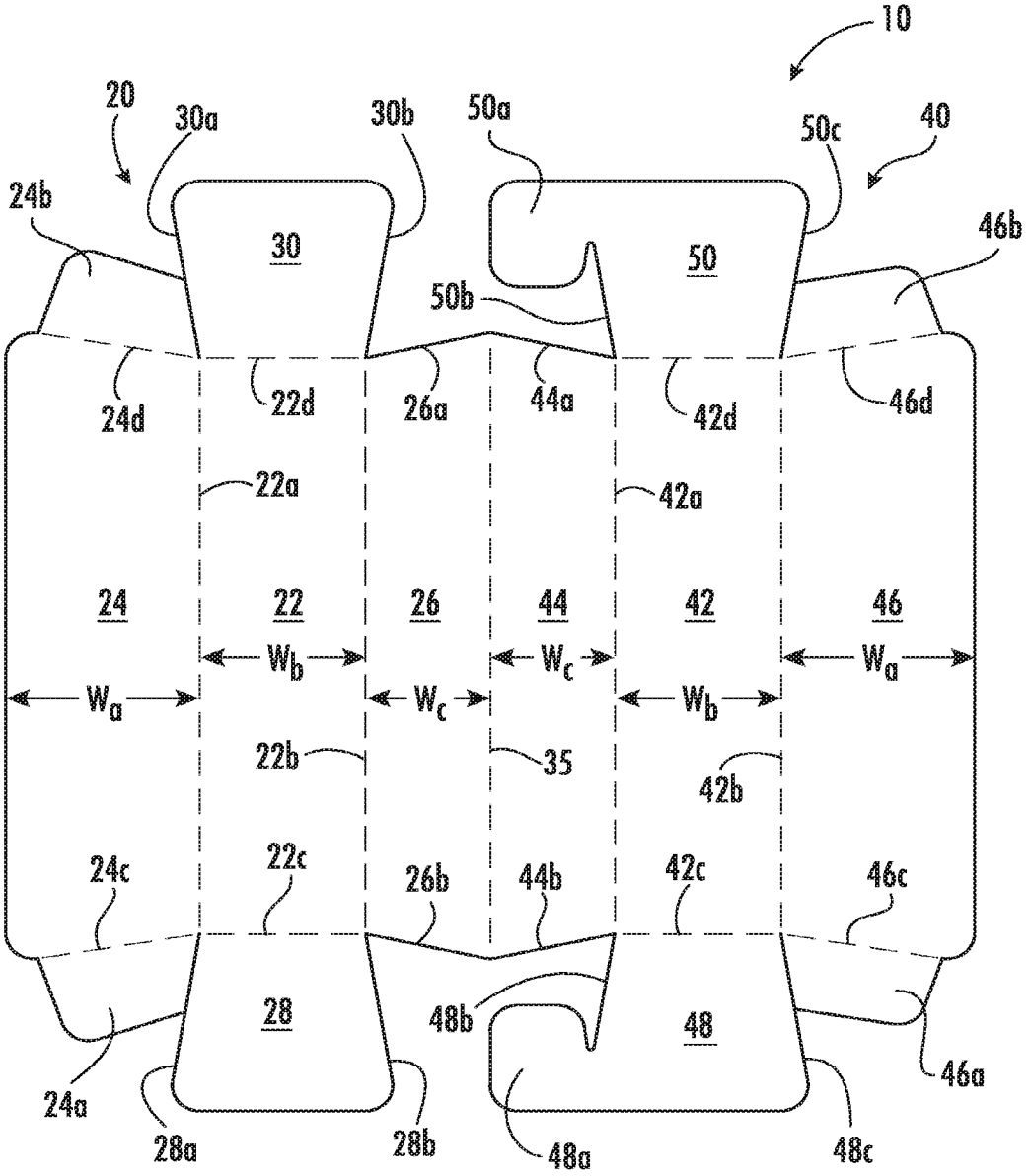
FIG. 2 is a top plan view of a blank for forming the tray of FIG. 1.

Referring to FIG. 2, the blank 10 includes the first compartment portion 20 which has a bottom panel 22, a first side panel 24 foldably connected to a first side edge 22*a* of the bottom panel 22, a second side panel 26 foldably connected to a second side edge 22*b* of the bottom panel 22, a front panel 28 foldably connected to a front edge 22*c* of the bottom panel 22 and a rear panel 30 foldably connected to a rear edge 22*d* of the bottom panel 22.

The blank 10 further includes the second compartment portion 40 which has a bottom panel 42, a first side panel 44 foldably connected to a first side edge 42*a* of the bottom panel 42 and also foldably connected to the second side panel 26 of the first compartment portion 20 along an adjoining fold line 35. Second compartment portion 40 further includes a second side panel 46 foldably connected to a second side edge 42*b* of the bottom panel 42, a front panel 48 foldably connected to a front edge 42*c* of the bottom panel 42 and a rear panel 50 foldably connected to a rear edge 42*d* of the bottom panel 42.

The front and rear panels 48 and 50 of the second compartment portion 40 each have an integral glue tab 48*a* and 50*a* for securement to exterior surfaces of the front and rear panels 28 and 30 of the first compartment portion 20. In addition, the first side panel 24 of the first compartment portion 20 has front and rear glue tabs 24*a* and 24*b* that are foldably connected to respective front and rear edges 24*a* and 24*d* thereof for securement to interior surfaces of the front and rear panels 28 and 30 of the first compartment portion 20. Similarly, the second side panel 46 of the second compartment portion 40 has front and rear glue tabs 46*a* and 46*b* foldably connected to respective front and rear edges 46*c* and 46*d* thereof for securement to interior surfaces of the front and rear panels 48 and 50 of the second compartment portion 40.

The front and rear edges of each side panel of each compartment portion 20, 40 are angled with respect to the side edges of the side panels. More particularly, the front and rear edges 24*c* and 24*d* of side panel 24 are angled with respect to the side edges of panel 24, and the front and rear edges 46*c* and 46*d* of side panel 46 are angled with respect to the side edges of panel 46. In addition, the front and rear panels 28 and 30 of compartment portion 20 have oppositely angled side edges 28*a*, 28*b* and 30*a*, 30*b* respectively, and the front and rear panels 48 and 50 of compartment portion 40 have oppositely angled side edges 48*b*, 48*c* and 50*b*, 50*c*, respectively.

Furthermore, the front edges of adjoining side panels are oppositely angled, and the rear edges of adjoining side panels are also oppositely angled. More particularly, the front edges 26*b* and 44*b* of adjoining panels 26 and 44 are oppositely angled, as are the rear edges 26*b* and 44*b* of adjoining panels 26 and 44

The first and second side edges 22*a* and 22*b* of the bottom panel 22 of compartment 20 and the first and second side edges 42*a* and 42*b* of the bottom panel 42 compartment portion 40 are parallel to one another, and to the adjoining fold line 35 between the adjoining panels 26 and 44.

With continuing reference to FIG. 2, the first side panel 24 of compartment portion 20 and the second side panel 46 of compartment portion 40 have an equal width $w_a$, the bottom panel 22 of compartment portion 20 and the bottom panel 42 of compartment portion 40 have an equal width $w_b$, and the second side panel 26 of compartment portion 20 and the adjoining first side panel 44 of compartment portion 40 have an equal width $w_c$. The width $w_a$ of side panels 24 and 46 is greater than the width $w_c$ of adjoining side panels 26 and 44.

Figure 3:
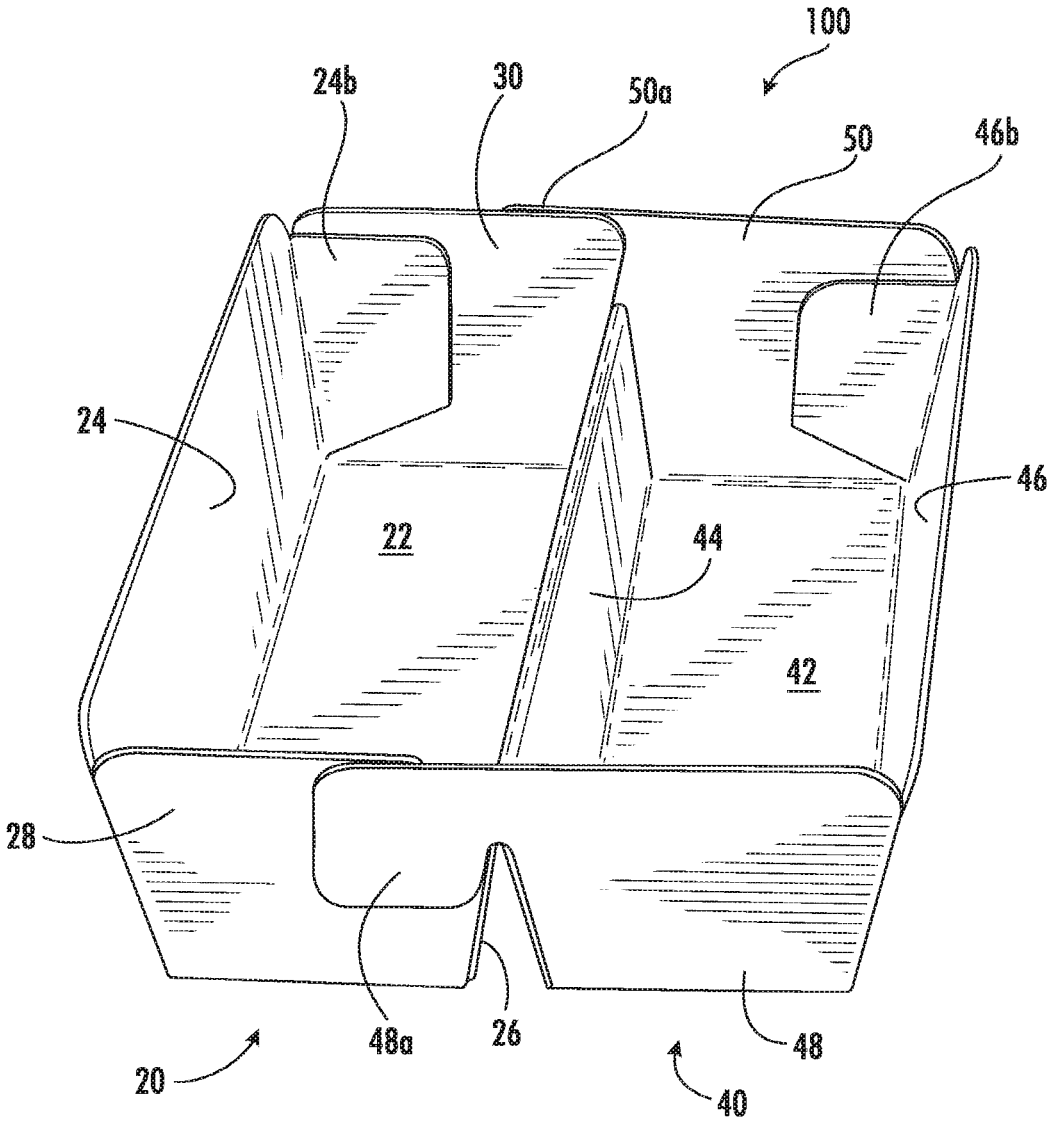
FIG. 3 is a perspective view of the tray formed from the blank of FIG. 2.
Figure 4:
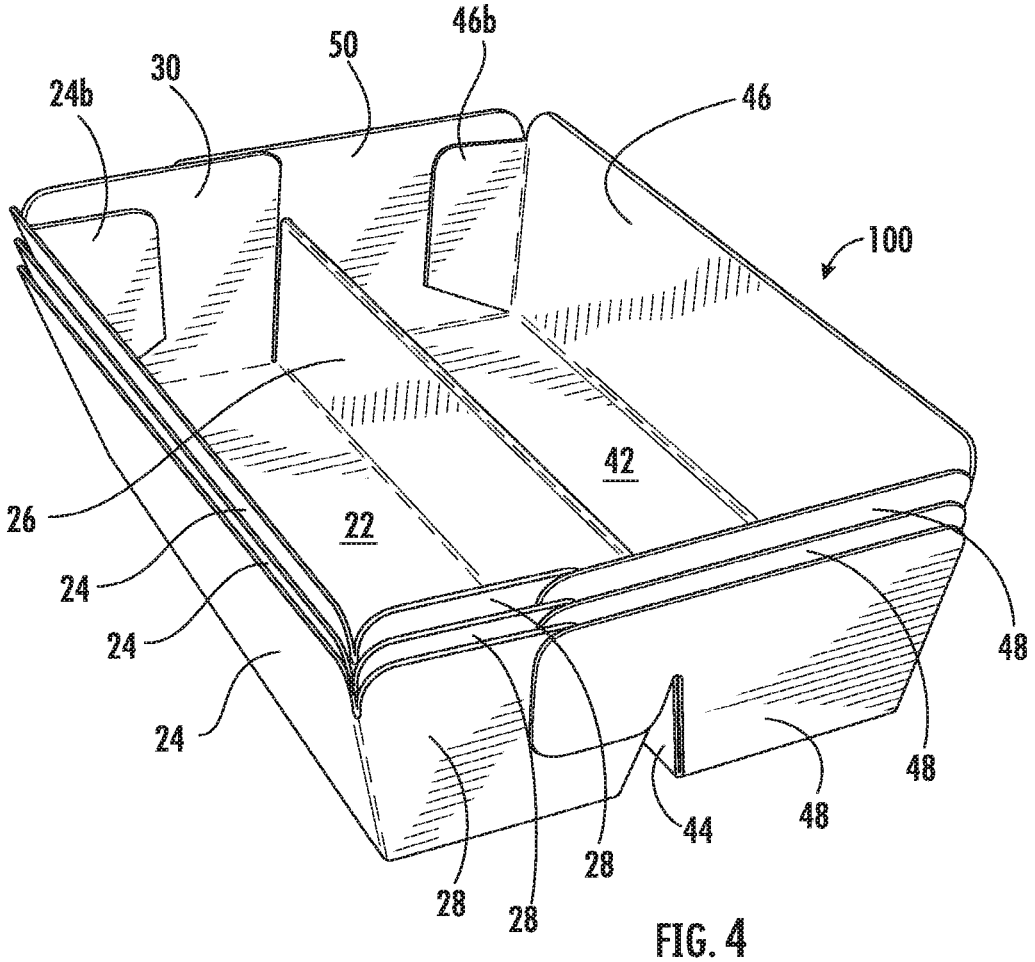
FIG. 4 is a perspective view of a plurality the trays of FIG. 3 nested together.

Referring to FIG. 3, to construct the tray 100 from the blank 10 the glue tabs 48*a* and 50*a* of the second compartment portion 40 are glued or otherwise secured to the exterior surfaces of the front and rear panels 28 and 30 of the first compartment portion 20. In addition, the front and rear glue tabs 24*a* and 24*b* are glued or otherwise secured to the interior surfaces of the front and rear panels 28 and 30 of the first compartment portion 20. In addition, the front and rear glue tabs 46*a* and 46*b* are glued or otherwise secured to the interior surfaces of the front and rear panels 48 and 50 of the second compartment portion 40. Once the tray 100 has been erected, a plurality of such trays 100 can be nested with one another so they can be packaged together for shipment and use, as best seen in FIG. 4.

Figure 5:
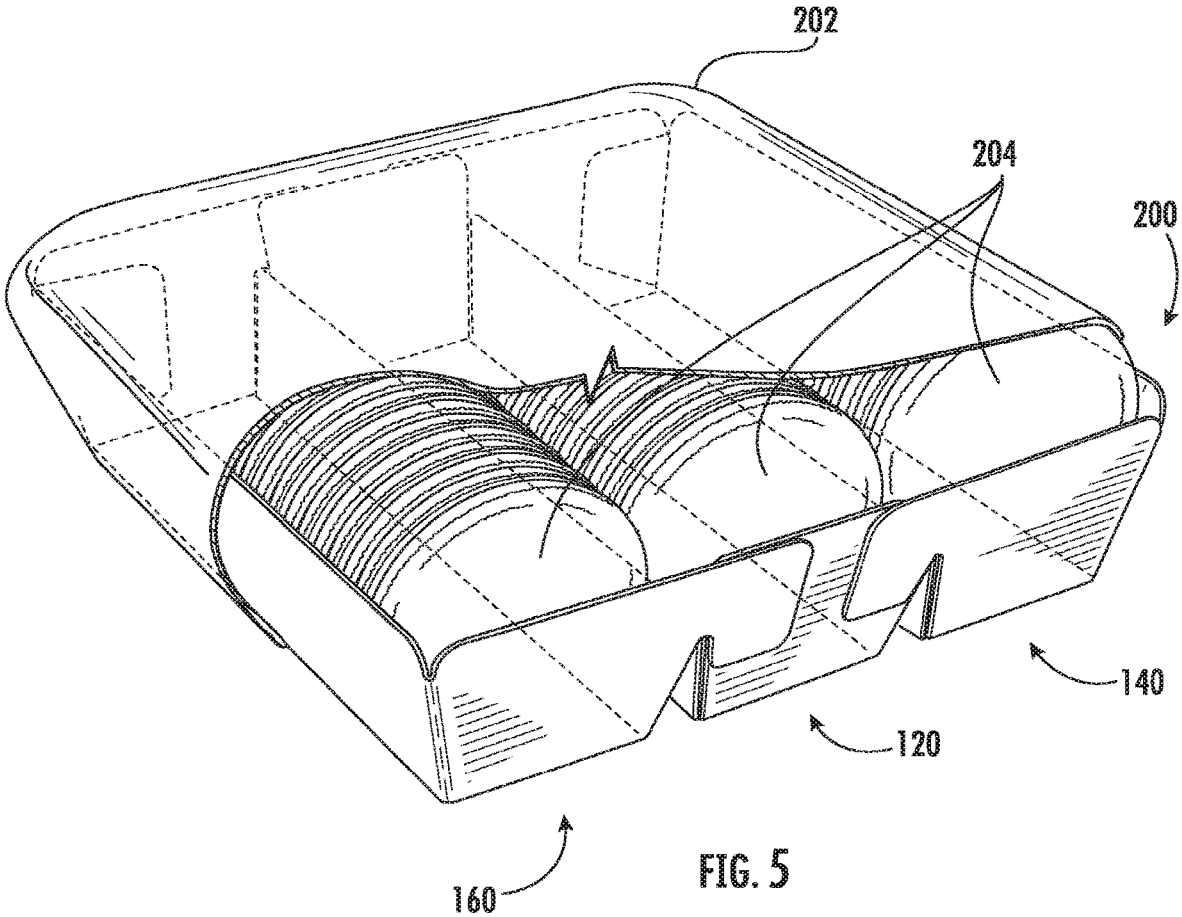
FIG. 5 is a perspective view of another embodiment of the tray of the subject invention, which has three divided compartments, and which is shown containing products and enclosed within a package.

Referring now to FIG. 5, there is illustrated another compartmented tray 200 contained within a packaging enclosure 202 and having three compartment portions 120, 140 and 160 for packaging food products 204 such as cookies or the like, and which is adapted and configured to be nested with other compartmented trays 200 so they can be packaged together for shipment and use, as explained in more detail below. The compartmented tray 200 is erected from a die cut paper or paperboard blank 110, which is illustrated in FIG. 6.

Figure 6:
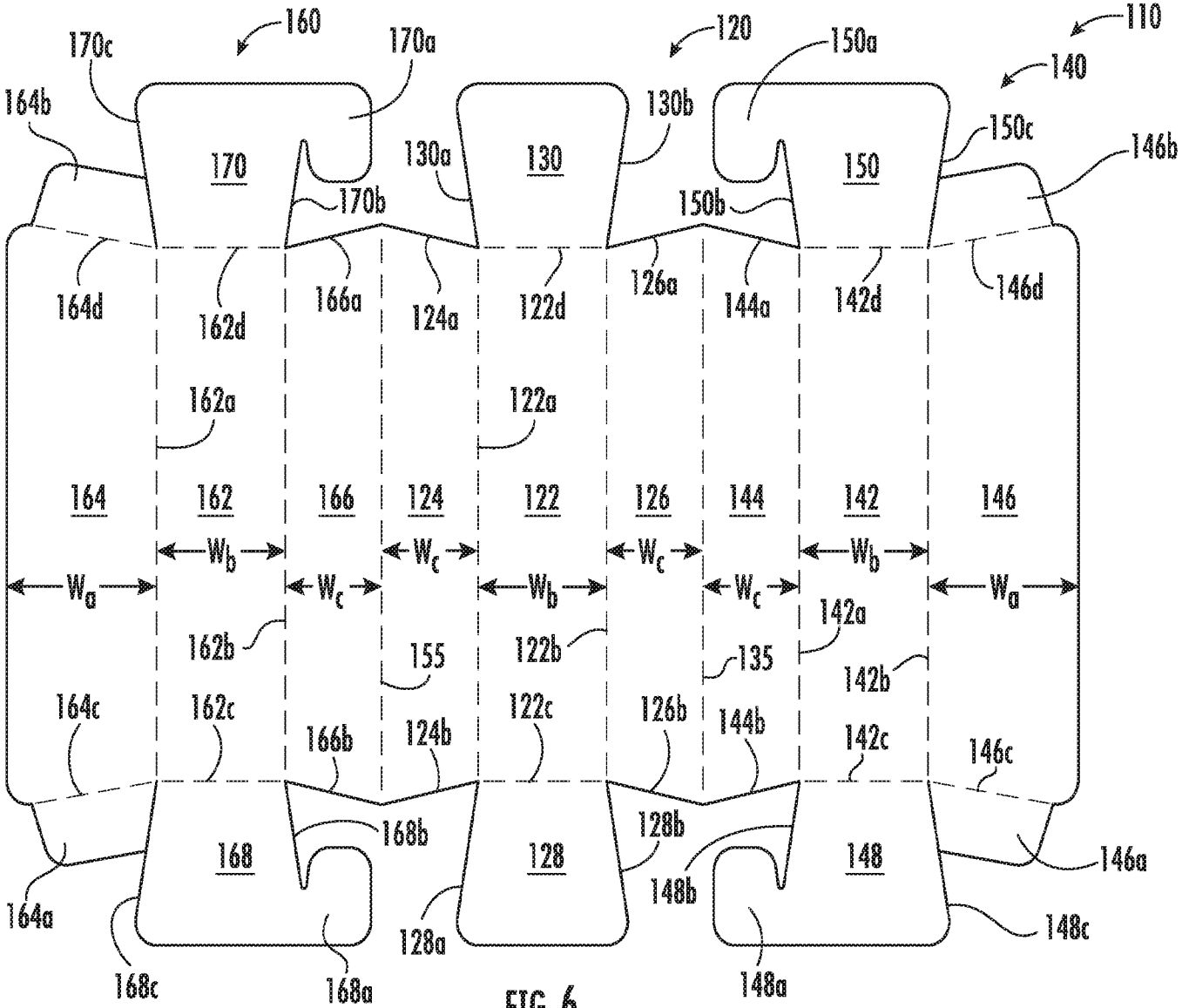
FIG. 6 is a top plan view of a blank for forming the tray of FIG. 5.

Referring to FIG. 6, the blank 110 includes first compartment portion 120 having a bottom panel 122, a first side panel 124 foldably connected to a first side edge 122*a* of the bottom panel 122, a second side panel 126 foldably connected to a second side edge 122*b* of the bottom panel 122, a front panel 128 foldably connected to a front edge 122*c* of the bottom panel 122 and a rear panel 130 foldably connected to a rear edge 122*d* of the bottom panel 122.

The blank 110 further includes second compartment portion 140 having a bottom panel 142, a first side panel 144 foldably connected to a first side edge 142*a* of the bottom panel 142 and foldably connected to the second side panel 126 of the first compartment portion 120 along an adjoining fold line 135, a second side panel 146 foldably connected to a second side edge 142*b* of the bottom panel 142, a front panel 148 foldably connected to a front edge 142*c* of the bottom panel 142 and a rear panel 150 foldably connected to a rear edge 142*d* of the bottom panel 142. The front and rear panels 148 and 150 of the second compartment portion 140 each have an integral glue tab 148*a* and 150*a* for securement to exterior surfaces of the front and rear panels 128 and 130 of the first compartment portion 120.

The second side panel 146 of the second compartment portion 140 has front and rear glue tabs 146*a* and 146*b* foldably connected to respective front and rear edges 146*c* and 146*d* thereof for securement to interior surfaces of the front and rear panels 148 and 150 of the second compartment portion 140.

The blank 110 further includes a third compartment portion 160 having a bottom panel 162, a first side panel 164 foldably connected to a first side edge 162*a* of the bottom panel 162 and a second side panel 166 foldably connected to a second side edge 162*b* of the bottom panel 162 and foldably connected to the first side panel 124 of the first compartment portion 120 along an adjoining fold line 155, a front panel 168 foldably connected to a front edge 162*c* of the bottom panel 162 and a rear panel 170 foldably connected to a rear edge 162*d* of the bottom panel 162.

The front and rear panels 168 and 170 of the third compartment portion 160 each have an integral glue tab 168*a* and 170*a* for securement to exterior surfaces of the front and rear panels 128 and 130 of the first compartment portion 120. The first side panel 164 of compartment portion 160 has front and rear glue tabs 164*a* and 164*b* that are foldably connected to respective front and rear edges 164*c* and 164*d* for securement to interior surfaces of the front and rear panels 168 and 170 of compartment portion 160.

The front and rear edges 164*c* and 124*d* of side panel 164 are angled with respect to the side edges of panel 164, and the front and rear edges 146*c* and 146*d* of side panel 146 are angled with respect to the side edges of panel 146. In addition, the front and rear panels 128 and 130 of compartment portion 120 have oppositely angled side edges 128*a*, 128*b* and 130*a*, 130*b* respectively, the front and rear panels 148 and 150 of compartment portion 140 have oppositely angled side edges 148*b*, 148*c* and 150*b*, 150*c*, respectively, and the front and rear panels 168 and 170 of compartment portion 160 have oppositely angled side edges 168*b*, 168*c* and 170*b*, 170*c*, respectively.

Furthermore, the front edges of adjoining side panels are oppositely angled, and the rear edges of adjoining side panels are also oppositely angled. More particularly, the front edges 126*b* and 144*b* of adjoining panels 126 and 144 are oppositely angled, as are the rear edges 126*b* and 144*b* of adjoining panels 126 and 144. Similarly, the front edges 166*b* and 166*a* and 124*a* of adjoining panels 166 and 124 are oppositely angled, as are the rear edges 166*b* and 124*b* of adjoining panels 166 and 124.

The first and second side edges 122*a* and 122*b* of the bottom panel 122 of compartment 120 and the first and second side edges 142*a* and 142*b* of the bottom panel 142 compartment portion 140 are parallel to one another, and to the adjoining fold line 135 between the adjoining panels 126 and 144. Similarly, the first and second side edges 122*a* and 122*b* of the bottom panel 122 of compartment 120 and the first and second side edges 162*a* and 162*b* of the bottom panel 162 compartment portion 160 are parallel to one another, and to the adjoining fold line 155 between the adjoining panels 166 and 124.

With continuing reference to FIG. 6, the first side panel 164 of compartment portion 160 and the second side panel 146 of compartment portion 140 have an equal width $w_a$, the bottom panel 122 of compartment portion 120, the bottom panel 142 of compartment portion 140 and the bottom panel 162 of compartment portion 160 have an equal width $w_b$, and the second side panel 126 of compartment portion 120 and the adjoining first side panel 144 of compartment portion 140 have an equal width $w_c$, and the first side panel 124 of compartment portion 120 and the adjoining second side panel 166 of compartment portion 160 also have an equal width $w_c$. The width $w_a$ of side panels 146 and 164 is greater than the width $w_c$ of adjoining side panels 126, 144 and 124, 166.

Figure 7:
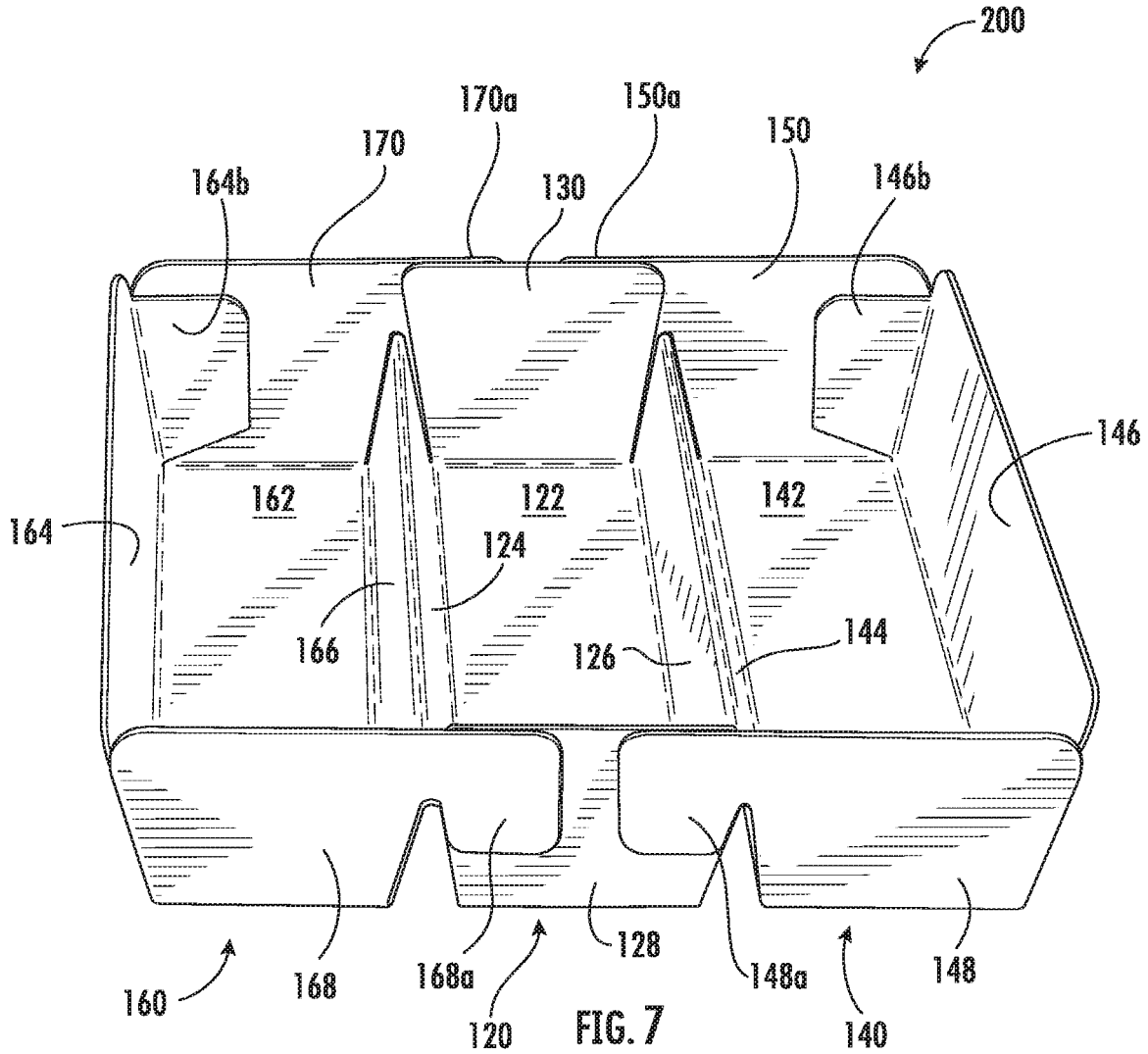
FIG. 7 is a perspective view of the tray formed from the blank of FIG. 6.

Referring to FIG. 7, to construct the tray 200 from the blank 110 the glue tabs 148*a* and 150*a* of the second compartment portion 140 are glued or otherwise secured to the exterior surfaces of the front and rear panels 128 and 130 of the first compartment portion 20, and the glue tabs 168*a* and 170*a* of the third compartment portion 160 are also glued or otherwise secured to the exterior surfaces of the front and rear panels 128 and 130 of the first compartment portion 20.

Figure 8:
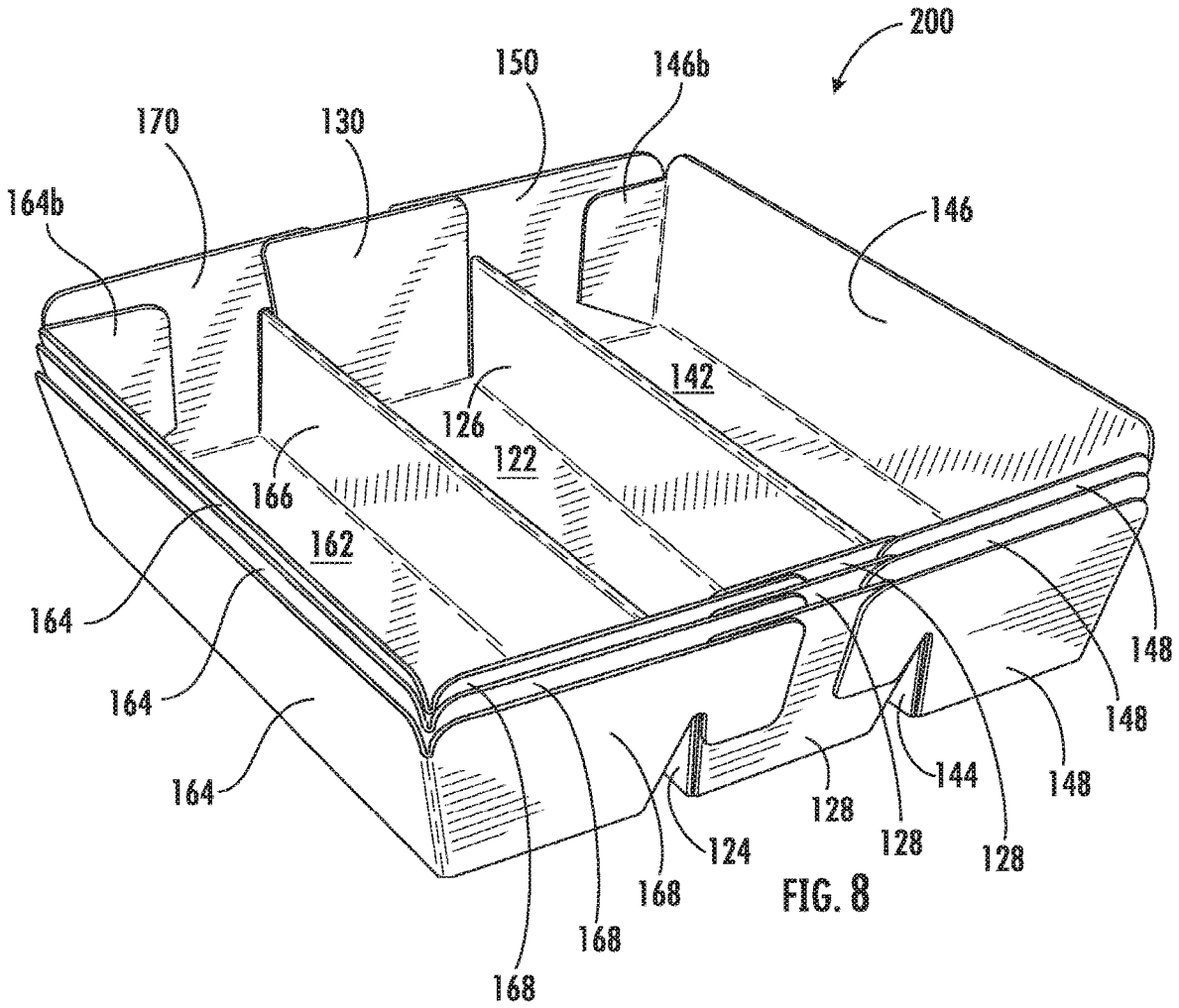
FIG. 8 is a perspective view of a plurality the trays of FIG. 7 nested together.

In addition, the front and rear glue tabs 146*a* and 146*b* are glued or otherwise secured to the interior surfaces of the front and rear panels 148 and 150 of compartment portion 140, and the front and rear glue tabs 164*a* and 164*b* are glued or otherwise secured to the interior surfaces of the front and rear panels 168 and 170 of the third compartment portion 160. Once the tray 200 has been erected, a plurality of such trays 200 can be nested with one another so they can be packaged together for shipment and use, as best seen in FIG. 8.

While the subject disclosure has been shown and described with reference to preferred embodiments, those skilled in the art will readily appreciate that changes or modifications may be made thereto without departing from the spirit or scope of the subject disclosure.

What is claimed is:

1. A blank for constructing a tray having divided compartments, comprising:

a) a first compartment portion having a bottom panel, a first side panel foldably connected to a first side edge of the bottom panel, a second side panel foldably connected to a second side edge of the bottom panel, a front panel foldably connected to a front edge of the bottom panel, and a rear panel foldably connected to a rear edge of the bottom panel; and b) a second compartment portion having a bottom panel, a first side panel foldably connected to a first side edge of the bottom panel and foldably connected to the second side panel of the first compartment portion along an adjoining fold line, a second side panel foldably connected to a second side edge of the bottom panel, a front panel foldably connected to a front edge of the bottom panel, and a rear panel foldably connected to a rear edge of the bottom panel, wherein the front and rear panels of the second compartment portion each have an integral glue tab that extends laterally inwardly therefrom toward the first compartment portion for securement to exterior surfaces of the front and rear panels of the first compartment portion, wherein each integral glue tab is partially separated from the front or rear panel from which it extends by a cutaway or recess.

2. A blank as recited in claim 1, wherein the first side panel of the first compartment portion has front and rear glue tabs foldably connected to respective front and rear edges thereof for securement to interior surfaces of the front and rear panels of the first compartment portion.

3. A blank as recited in claim 1, wherein the second side panel of the second compartment portion has front and rear glue tabs foldably connected to respective front and rear edges thereof for securement to interior surfaces of the front and rear panels of the second compartment portion.

4. A blank as recited in claim 1, further comprising a third compartment portion having a bottom panel, a first side panel foldably connected to a first side edge of the bottom panel and a second side panel foldably connected to a second side edge of the bottom panel and foldably connected to the first side panel of the first compartment portion along an adjoining fold line, a front panel foldably connected to a front edge of the bottom panel and a rear panel foldably connected to a rear edge of the bottom panel, wherein the front and rear panels of the third compartment portion each have an integral glue tab for securement to exterior surfaces of the front and rear panels of the first compartment portion.

5. A blank as recited in claim 4, wherein the first side panel of the third compartment portion has front and rear glue tabs foldably connected to respective front and rear edges thereof for securement to interior surfaces of the front and rear panels of the third compartment portion.

6. A blank as recited in claim 1, wherein the front and rear edges of each side panel of each compartment portion are obliquely angled with respect to the side edges of the side panels.

7. A blank as recited in claim 1, wherein the front and rear panels of each compartment portion have oppositely angled side edges.

8. A blank as recited in claim 1, wherein the front edges of adjoining side panels are oppositely angled, and the rear edges of adjoining side panels are also oppositely angled.

9. A blank as recited in claim 1, wherein the first and second side edges of the bottom panel of each compartment portion are parallel to one another and to the adjoining fold line.

10. A blank as recited in claim 1, wherein the second side panel of the first compartment portion and the adjoining first side panel of the second compartment portion have an equal width, which is less than a width of the bottom panel of each of the first and second compartment portions, which is less than a width of the first side panel of the first compartment portion and also less than a width of the second side panel of the second compartment portion.

11. A blank as recited in claim 10, wherein the width of the first side panel of the first compartment portion and the width of the second side panel of the second compartment portion are equal to one another.

12. A blank as recited in claim 1, wherein the bottom panels of each compartment portion have an equal width.

13. A blank as recited in claim 1, wherein the cutaway or recess is shaped to correspond to a structure formed by the first side panel of the second compartment portion and the second side panel of the first compartment portion, which are foldably connected together by the adjoining fold line, when the first side panel of the second compartment portion and the second side panel of the first compartment portion are folded about the adjoining fold line in the constructed tray.

14. A tray having divided compartments, comprising:

a) a first compartment portion having a bottom panel, a first side panel foldably connected to a first side edge of the bottom panel, a second side panel foldably connected to a second side edge of the bottom panel, a front panel foldably connected to a front edge of the bottom panel and a rear panel foldably connected to a rear edge of the bottom panel; and b) a second compartment portion having a bottom panel, a first side panel foldably connected to a first side edge of the bottom panel and foldably connected to the second side panel of the first compartment portion along an adjoining fold line, a second side panel foldably connected to a second side edge of the bottom panel, a front panel foldably connected to a front edge of the bottom panel and a rear panel foldably connected to a rear edge of the bottom panel, wherein the front and rear panels of the second compartment portion each have an integral glue tab that extends laterally inwardly therefrom toward the first compartment portion, wherein each integral glue tab is secured to exterior surfaces of the front and rear panels, respectively, of the first compartment portion, wherein each integral glue tab is partially separated from the front and rear panel from which it extends by a cutaway or recess.

15. A tray as recited in claim 14, wherein the first side panel of the first compartment portion has front and rear glue tabs foldably connected to respective front and rear edges thereof and secured to interior surfaces of the front and rear panels of the first compartment portion.

16. A tray as recited in claim 14, wherein the second side panel of the second compartment portion has front and rear glue tabs foldably connected to respective front and rear edges thereof and secured to interior surfaces of the front and rear panels of the second compartment portion.

17. A tray as recited in claim 14, further comprising a third compartment portion having a bottom panel, a first side panel foldably connected to a first side edge of the bottom panel and a second side panel foldably connected to a second side edge of the bottom panel and foldably connected to the first side panel of the first compartment portion along an adjoining fold line, a front panel foldably connected to a front edge of the bottom panel and a rear panel foldably connected to a rear edge of the bottom panel, wherein the front and rear panels of the third compartment portion each have a glue tab secured to exterior surfaces of the front and rear panels of the first compartment portion.

18. A tray as recited in claim 17, wherein the first side panel of the third compartment portion has front and rear glue tabs foldably connected to respective front and rear edges thereof secured to interior surfaces of the front and rear panels of the third compartment portion.

19. A tray as recited in claim 14, wherein each integral glue tab is shaped by the cutaway or recess such that a portion of the integral glue tab is disposed at an elevation above the adjoining fold line between the first and second compartments and a portion of the integral glue tab is disposed at an elevation below the adjoining fold line between the first and second compartments.

* * * * *